United States Patent [19]

Leroy et al.

[11] 4,243,211

[45] Jan. 6, 1981

[54] TUYERE FOR USE IN REFINING LIQUID METALS

[75] Inventors: Pierre J. Leroy, St. Germain en Laye; Jean P. Bastien, Saint Priest en Jarez; Emile J. Sprunck, Moyeuvre, all of France

[73] Assignee: Creusot-Loire, Paris, France

[21] Appl. No.: 58,452

[22] Filed: Jul. 18, 1979

[30] Foreign Application Priority Data

Jul. 19, 1978 [FR] France ..... 78 21372

[51] Int. Cl.[3] ..... C21B 7/16

[52] U.S. Cl. ..... 266/268; 75/60

[58] Field of Search ..... 266/268; 75/60

[56] References Cited

U.S. PATENT DOCUMENTS

| | | | |
|---|---|---|---|
| 3,201,104 | 8/1965 | Berry | 75/60 |
| 3,240,481 | 3/1966 | Smith | 75/60 |
| 3,322,348 | 5/1967 | Vonnemann | 75/60 |
| 3,337,203 | 8/1967 | Smith | 75/60 |
| 3,793,002 | 1/1974 | Borgnat | 75/60 |

*Primary Examiner*—P. D. Rosenberg

*Attorney, Agent, or Firm*—Robert D. Yeager

[57] ABSTRACT

An improved construction for the refining gas passage of a tuyere for use in refining molten metal in a converter. The transverse section of the refining gas passage has a continuous outer enclosure and a central opening defining a plurality of radially extending branches whose total perimeter exceeds the circumference of a circle having an area equivalent to the central opening.

12 Claims, 9 Drawing Figures

IX'
IX'
74
78'
76'
78'
80'
78'
70'
72'

VIII
VIII
88
70'
86
84
70
82

IX
IX
80
78
76
75
74
78
72
70

TUYERE FOR USE IN REFINING LIQUID METALS

BACKGROUND OF THE INVENTION

1. Field of the Invention

The present invention relates to a tuyere for use in refining molten metals; more particularly, to a tuyere whose flow passage for refining gas is configured to provide in transverse section a greater perimeter than a circular flow passage of corresponding area.

2. Description of the Prior Art

The refining of molten pig iron into steel in a bottom-blown steelmaking converter is well-known. Generally, the refining process involves the use of concentric tube tuyeres embedded in the converter beneath the surface of the molten metal bath; the concentric tubes usually have a constant thickness and are of circular cross section. An oxidizing gas, usually pure oxygen, is blown into the bath through the central (inner) tube of each tuyere and a protective fluid is blown through the annulus formed by the inner and outer tubes of each tuyere to prevent undue wear of the tuyere tip. U.S. Pat. No. 3,817,744 discusses such a refining process in detail.

One of the problems that confronts steelmakers is the determination of the optimum number of tuyeres to be used in a converter of given size. If the number of tuyeres is large, the technical problems surrounding the introduction of fluids into the tuyeres and the control of their respective flow rates are complex. Thus, generally it is desirable to utilize the minimum number of tuyeres. But, if a small number of tuyeres are selected, the cross-sectional area of the passage used for oxidizing gas in each tuyere must be relatively large to maintain the desired blowing period and, in the case of a passage of circular cross section, this means a passage of relatively large diameter.

The use of large diameter oxygen flow passages in a bottom blown refining process can result in a number of process disadvantages such as the throwing-up (e.g. slopping, spitting) of metal and/or slag from the bath with a consequent formation of skulls around the interior of the converter mouth, and an inadequate distribution of oxidizing gas within the metal bath. These disadvantages manifest themselves in slags with unduly high iron contents, the production of reddish-brown smoke, high oxygen consumption, etc.

U.S. Pat. No. 3,802,684 addresses to some extent the problem of "spitting" in bottom blown steelmaking processes as caused by large diameter circular flow passages in the tuyeres. The solution put forth in that patent is to provide an inner tube having a noncircular oblong transverse cross section and an outer tube of the same shape.

SUMMARY OF THE INVENTION

The present invention overcomes the disadvantages arising from a large diameter circular passage for oxidizing gas in each concentric tube tuyere, yet permits the use of a moderate number of tuyeres for a given converter size and the maintenance of customary blowing periods.

The present invention provides, in a tuyere for use in refining molten metal in a converter, the tuyere having a passage for refining gas and a passage for protective fluid, an improved construction for said refining gas passage comprising: a transverse section having a continuous outer enclosure and a central opening defining a plurality of radially extending branches whose total perimeter exceeds the circumference of a circle having an area equivalent to the central opening. The central opening thus has the general appearance of a star having several arms. For any given transverse section, the invention provides a perimeter of contact between the refining gas, usually oxygen, and the metal bath into which the gas is introduced that is greater than in the case of a refining gas passage having a circular opening. The construction of the present invention permits, however, the outside of the tuyere to remain cylindrical, as is the customary tuyere configuration.

In one embodiment of the invention, the central opening is continuous; i.e., there are no walls separating one portion of the opening from another. In a second embodiment, the central opening is discontinuous; i.e., the opening comprises a plurality of discrete passages, preferably formed of tubular members, with the walls of these passages dividing the central opening. In both embodiments, however, the overall appearance of the central opening is that of a star having a plurality of radially extending arms.

In one variant of the present invention, the transverse section of the central opening for passage of refining gas is maintained uniformly throughout the length of the tuyere. Thus, for example, if the tuyere consists of only two concentric tubes, the inner wall of the inner tube then possesses a longitudinal profile that is either cylindrical or helical. The latter is useful because the centrifugal force imparted to the refining gas improves its contact with the metal bath upon impact with it.

In a second variant of the invention, a tuyere consisting of two concentric tubes may have a refining gas passage whose longitudinal profile generally is convergent/divergent from inlet to outlet; as in the first variant, the inner wall of the inner tube may possess a longitudinal profile that is either cylindrical or helical. This convergent/divergent profile expecially is useful for consumable tuyeres; as will be described below, the convergent/divergent profile may be so arranged as to be preserved throughout the wearing life of the tuyere.

Other features and advantages of the present invention will be more fully understood from the following description, considered together with the accompanying drawings wherein like parts are identified by the same reference numeral.

DESCRIPTION OF THE PREFERRED EMBODIMENTS

The present invention is for use in a tuyere comprising at least two metal tubes concentrically arranged to provide a narrow annulus between them. Refining gas is fed into the inner tube(s) and a fluid for protecting the tuyere against wear under the action of heat is fed into the aforesaid annular space.

Figure 1:
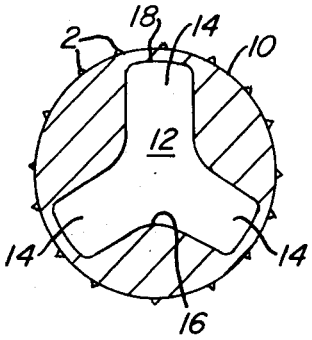
FIG. 1 is a transverse section through the inner tube of a concentric tube tuyere, illustrating a central opening in the tube in the shape of a star having three arms.
Figure 2:
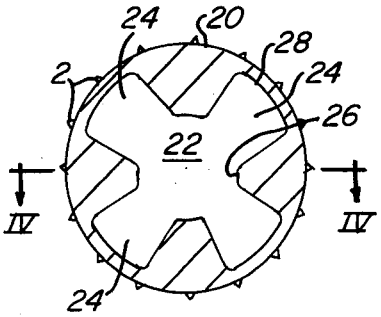
FIG. 2 is a transverse section through the inner tube of a concentric tube tuyere, illustrating a central opening in the shape of a star having four arms, said shape also being referred to as a Greek cross or a Saint Andrew's cross.
Figure 3:
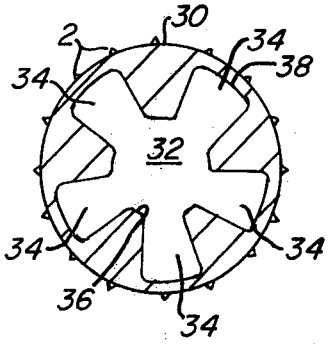
FIG. 3 is a transverse section through the inner tube of a concentric tube tuyere, illustrating a central opening in the shape of a conventional star having five arms.

Referring to the drawings, particularly to FIGS. 1–3, there are shown transverse sections of the inner tubes 10, 20 and 30 of tuyeres constructed in accordance with the present invention. It is understood, of course, that inner tubes 10, 20 and 30 are each surrounded by a conventional outer tube (not shown) to form a concentric tuyere. Thin longitudinal or helical ribs 2 extend along the length of each of inner tubes 10, 20 and 30 and act to center the inner tube within its surrounding outer tube. In operation, fluid for protecting the tuyere against wear is introduced into the space thus formed between the inner and outer tubes.

The central openings 12, 22, and 32 constitute the passageways for the flow of refining gas, which, in the refining of molten iron is substantially pure oxygen, through inner tubes 10, 20 and 30, respectively. Central openings 12, 22 and 23 include radially extending branches (or arms) 14, 24 and 34, which give the openings the general appearance of a star. Adjacent branches 14, 24, 34 are separated by parts 16, 26, 36 of relatively substantial thickness which are integrally formed in tubes 10, 20, 30. The ends of branches 14, 24, 34 are bounded, however, by wall portions 18, 28, 38 which possess a thickness generally corresponding to a conventional circular tube used for the same purpose.

It may be seen that the perimeter of each of central openings 12, 22, 32 is large compared with the circumference of a circle having an area equivalent to a central opening according to the invention. This increased perimeter provides an increased zone of contact between the refining gas and the metal bath into which the gas is blown and, thereby, tends to reduce the amount of ejecta from the bath above compared with circular flow passages at equivalent flow rates and heat sizes. For example, tube 20 possesses a perimeter of cross section for the passage of refining gas that is 1.7 times the perimeter of a circle of equivalent area. The corresponding ratio for tube 30 is even higher than 1.7 but the fabrication of a tube configured like tube 30 is more complex.

The transverse cross sections shown in FIGS. 1–3 may be maintained uniformly throughout the length of inner tubes 10, 20, 30. In one such case, successive transverse cross sections of the inner tubes possess the same angular orientation with respect to each other, and, in another case, successive transverse cross sections are angularly offset from one another as when tubes 10, 20, 30 are twisted after forming. Maintaining a uniform transverse cross section throughout the length of inner tubes 10, 20, 30 fails, however, to take advantage of a further construction feature of the present invention now to be described.

When the refining gas passed through a submerged tuyere contains a solid refining agent, for example powdered lime in the case of steelmaking, the maintainance of laminar flow within the flow passage, without the presence of secondary vortices or dead zones of low or zero speed, is highly desirable. This objective can be achieved by providing the inner tubes 10, 20 30 with a convergent/divergent longitudinal profile, either by uniformly varying their transverse sections or selectively varying such sections by, for example, applying variations only in the parts of relatively large thickness, e.g. 16, 26, 36.

Generally, the convergent portion of the profile is provided at the inlet of the tuyere in that part of the length which remains at the end of tuyere campaign. In this way, the benefits of the convergent portion may be had throughout the life of a consumable tuyere. Further, there are two groups of possible configurations downstream from the neck of the convergent portion, in the consummable part of the tuyere:

(a) either to maintain the transverse sections equal to those of the neck of the convergent part, the longitudinal profile of the inner wall of the inner tube then being either cylindrical or helical, from the neck of the convergent part up to the outlet of the tuyere; or (b) to cause the transverse sections to follow a divergent profile, which is either longitudinal or helical, it being more possible for the divergence to be applied either to the entire transverse section or only to parts 16, 26, 36 of relatively large thickness.

Figure 4:
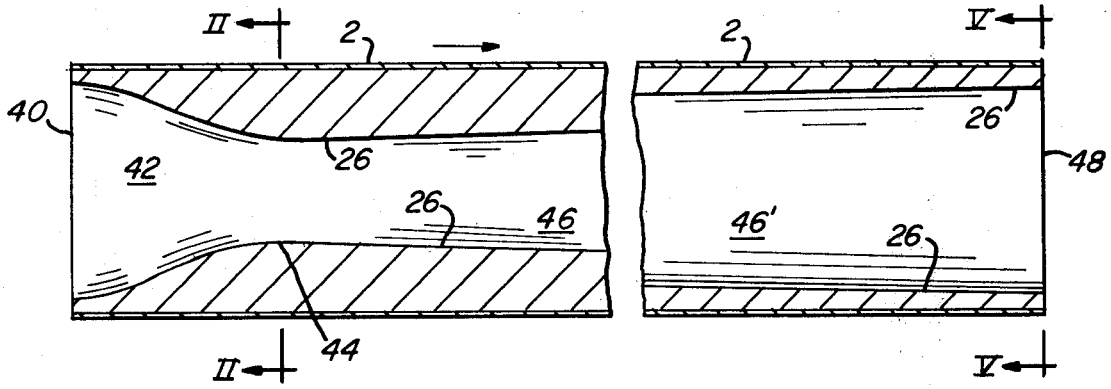
FIG. 4 is a fragmentary longitudinal section through the inner tube of a concentric tube tuyere taken along the line IV—IV of FIG. 2 which, in turn, is a transverse section taken along the line II—II of FIG. 4.
Figure 5:
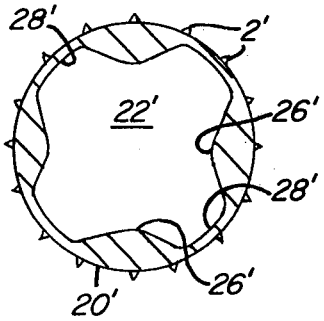
FIG. 5 is a transverse section taken along the line V—V of FIG. 4.

FIG. 4, taken with FIGS. 2 and 5, illustrates the application of a convergent/divergent profile to inner tube 20. In that showing, end portions 28 of branches 24 are of uniform thickness throughout the length of inner tube 20; parts 26, separating the branches, however, each have the longitudinal profile shown in FIG. 4, thereby forming, from the inlet 40 along the direction of flow indicated by the arrow, a convergent section 42, a neck 44, and a divergent section 46, 46'. The transverse section 22' of the outlet 48 inner tube 20' is shown in FIG. 5, with prime indications on corresponding parts.

Exemplary of the dimensions for inner tube 20 as just described are as follows: The overall length of inner tube 20 is 1.10 meters. At inlet 40, the inside diameter is 34 millimeters; the convergent section 42 is 30 millimeters in length; the inside diameter of the neck (shown in section in FIG. 2) is 16 millimeters opposite parts 26 and 34 millimeters at end portions 28. The divergent section 46, 46' constitutes the balance of the length of inner tube 20. At outlet 48, the inside diameter is 25 millimeters opposite parts 26' and again, 34 millimeters at end portions 28'. The ratio of the perimeter of central opening 22' to a circle of equivalent area does not exceed about 1.15 at outlet 48, but the ratio increases with wear of the tuyere and tends toward a value of 1.7 present at neck 44.

A further advantage of the convergent/divergent profile is that pressure losses, which might otherwise occur as a function of the shortening of the tuyere through wear, are held to a minimum. Thus, the variation in permeability (characterized by the flow-rate of refining gas passing under a given pressure) of all the tuyeres in the same converter bottom is small or zero as the base becomes worn. This advantage is of particular value where pressure adjustments are programmed throughout the life of the converter bottom and the converter is operated automatically.

Figure 6:
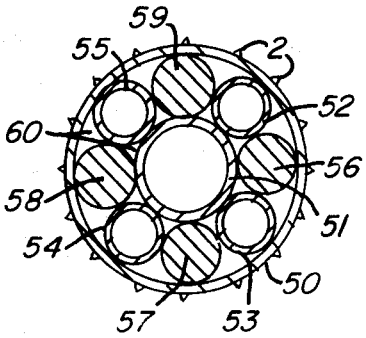
FIG. 6 is a transverse section through the inner tube of a concentric tube tuyere, illustrating another embodiment of the present invention.

FIG. 6 shows the transverse section of the inner tube of a still further embodiment of a tuyere constructed in accordance with the present invention. In that embodiment, an inner circular tube 50 contains individual tubes 51, 52, 53, 54 and 55 and cylindrical rods 56, 57, 58 and 59. Openings 60 in the shape of curvilinear triangles exist between the tubes and the rods. Tubes 51, 52, 53, 54 and 55 comprise a discontinuous central opening for passage of refining gas and, as seen in FIG. 6, take on the appearance of a star having four radially extending branches or arms.

One technique for feeding fluids to an assembly of the type shown in FIG. 6 is to feed refining gas to all five tubes, 51, 52, 53, 54, 55, and all openings 60 under the same pressure. At the outlet of the tuyere, the contact between the refining gas molecules and the metal bath is improved by the presence of the four dead zones corresponding to the ends of rods 56, 57, 58, 59.

Another such feeding technique involves feeding refining gas to openings 60 at a lower pressure than that used in feeding the five tubes. This pressure differential also results in improved contact between the refining gas and the metal bath and, to some extent, is equivalent to the effect produced by a multi-hole lance in top-blowing processes.

A variation of the embodiment shown in FIG. 6 may be produced by substituting four tubes, 56', 57', 58', 59' (not shown) for rods 56, 57, 58, 59; these tubes would be of the same dimensions as tubes 52, 53, 54, 55. In this variation, refining gas at a relatively high pressure $P_1$ is blown into tubes 51, 52, 53, 54, 55 and at a substantially lower pressure $P_2$ into the four tubes 56', 57', 58', 59' and openings 60. Again the observation of this blowing pressure differential results in good contact between the refining gas and the metal bath.

Figures 7, 8, 9:
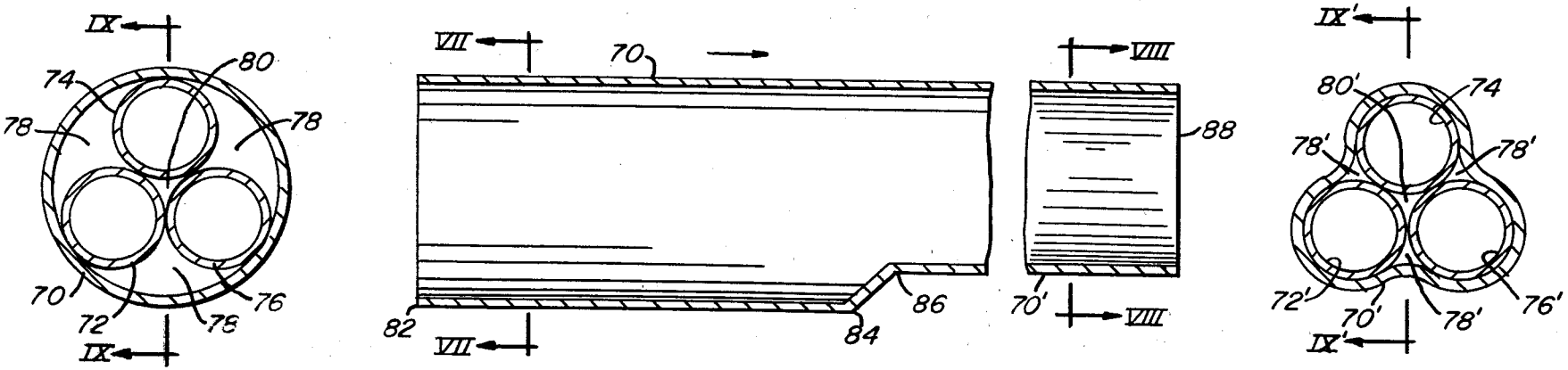
FIG. 7 is a transverse section through the inner and outer tubes of an alternate embodiment of a tuyere employing the present invention, which section is taken along line VII—VII of FIg. 7.
FIG. 8 is a transverse section through the inner and outer tubes of the tuyere of FIG. 7, but being axially spaced therefrom and along the line VIII—VIII of FIG. 9.
FIG. 9 is a fragmentary longitudinal section through the outer tube only of FIGS. 7 and 8, taken respectively along the lines IX—IX and IX'—IX' of those figures.

Referring now to FIGS. 7–9, there is shown a still further embodiment of the present invention. This embodiment includes an outer tube 70, 70' which encloses three tubes of smaller diameter 72, 74, 76. The tubes are shown in FIG. 8 with prime reference numerals.

Tubes 72, 74, 76 preferably are of equal diameters and are arranged within tube 70 to be substantially tangent to its inside diameter. Tubes 72, 74 and 76 preferably are constructed of copper and tube 70 of ordinary steel. As arranged, openings 78, in the shape of curvilinear triangles, are formed by the walls of two adjacent inner tubes and the inside wall of outer tube 70. A smaller opening 80, also in the shape of a curvilinear triangle is formed between the three inner tubes 72, 74, 76.

As apparent from FIG. 9, the transverse section of FIG. 7 is maintained over the length 82–84 of tube 70, which corresponds to the length of the tuyere remaining at the end of a bottom campaign. Beginning at 84 and proceeding in the direction of refining gas flow indicated by the arrow, tube 70 transitions from a circular cross section to a necked down section 84–86 to a cross section (best shown in FIG. 8) that closely corresponds to the outer profile of the three inner tubes 72', 74', 76'; this latter profile, which obtains for the remainder of the length of the tuyere, represents a discontinuous central opening for the passage of refining gas that is in the shape of a star having three arms. The openings 78' thus become narrower but the opening 80' remains unchanged in size. The length of tube 70, from 86 to outlet 88, corresponds to the portion of the tuyere that is consumed during the wearing of the converter bottom.

The three inner tubes 72, 74, 76 are each equipped on their outer surfaces with thin longitudinal ribs (not shown). The ribs have a height of 0.12 millimeter. This well-defined height determines a very narrow space between each of the three inner tubes 72, 74, 76 and the outer tube 70, and also between adjacent pairs of inner tubes.

In operation, the tuyere just described is used by introducing refining gas, usually pure oxygen, into the three inner tubes 72, 74, 76 while a protective fluid, for example, domestic fuel oil, is introduced into the outer tube 70. Over the length 82–84, the longitudinal passages represented by openings 78 act as chambers for accumulating pressurized fuel oil, whereas the central passage 80 and the narrow spaces between the tubes are also filled with fuel oil. As the fuel oil is forced into the narrowed openings 78' in the length of the tuyere from 86 to outlet 88, it is highly effective in protecting the tuyere against wear at outlet 88, yet the consumption of fuel oil per ton of refined metal is held to moderate levels. The tuyere construction thereby is able to take advantage, in general, of the improvements described in U.S. Pat. No. 4,157,813.

The embodiment of the present invention just described is also applicable to tuyeres having refining gas passages which, in transverse section, are in the shape of a star having n arms. Such a tuyere may be constructed by surrounding a central tube with a ring of n tubes, all of which are tangential to the outside of the central tube and tangential to the inside of the outer tube. The n tubes of the ring all have the same diameter, but the central tube may have a different diameter. Preferably, the outer tube, which encloses the other tubes, has a circular cross section at least over a portion of its length.

A generalization of this example consists in juxtaposing adjacent tubes which are located inside a tubular metal envelope of any suitable geometrical transverse section, it being possible for these various tubes to be fed with refining gas either under the same pressure or under different pressures in two groups of tubes, while the tubular metal envelope and the spaces between the various tubes are fed with fluid for protecting against wear.

In brief, the various embodiments of the invention described above all tend to improve the contact between the gas molecules in the jet of refining gas leaving the tuyere and the liquid metal bath. By virtue of this effect, it becomes possible to retain a relatively large transverse section per tuyere of the passage for the refining gas, for example greater than 7 square centimeters per tuyere, without having the above-mentioned disadvantages arising from a large circular jet of more than 3 centimeters diameter.

This relatively large transverse section per tuyere, produced according to the invention, in turn makes it possible to limit the number of tuyeres, which is an important technological advantage in practice, without suffering the disadvantages of too large a diameter of a tube of circular cross-section for the passage of the refining gas.

It will be apparent to those skilled in the art that tuyeres constructed in accordance with the present invention may be fabricated by a variety of well-known techniques including drawing, machining and/or twisting.

What is claimed is:

1. In a tuyere for use in refining molten metal in a converter, said tuyere having a passage for refining gas and a passage for protective fluid, an improved construction for said refining gas passage comprising:

a transverse section having a continuous outer enclosure and a central opening defining a plurality of radially extending branches whose total perimeter exceeds the circumference of a circle having an area equivalent to said central opening.

2. The improvement recited in claim 1 wherein:

said central opening is continuous.

3. The improvement recited in claim 1 wherein:

said central opening is discontinuous.

4. The improvement recited in claim 3 wherein:

said central opening includes an inner enclosure and a plurality of peripheral enclosures spaced thereabout.

5. The improvement recited in claim 4 wherein:

said peripheral enclosures are separated from one another by solid members.

6. The improvement recited in claim 3 wherein:

said central opening includes at least three of said branches, each branch being a circular enclosure.

7. The improvement recited in claim 6 wherein:

the longitudinal profile of said continuous outer enclosure, proceeding from the inlet of the tuyere to its outlet, defines a cylindrical portion followed by a neckeddown portion closely conforming to the outer surfaces of said circular enclosures.

8. The improvement recited in claim 6 wherein:

a plurality of curvilinear triangularly-shaped openings are present in the area remaining within said continuous outer enclosure, said openings being adaptable for the passage of said protective fluid.

9. The improvement recited in claim 1 wherein:

said branches have substantially identical shapes and the inner wall of said outer enclosure is of uniform thickness throughout the length of said tuyere.

10. The improvement recited in claim 1 wherein:

the longitudinal profile of said refining gas passage, proceeding from inlet to outlet, defines a convergent portion followed by a divergent portion.

11. The improvement recited in either claim 1 or claim 10 wherein:

successive transverse sections taken along the length of said refining gas passage possess the same angular orientation with respect to each other.

12. The improvement recited in either claim 1 or claim 10 wherein:

successive transverse sections taken along the length of said refining gas passage are angularly offset from one another.

* * * * *

UNITED STATES PATENT AND TRADEMARK OFFICE

CERTIFICATE OF CORRECTION

PATENT NO. : 4,243,211

DATED : January 6, 1981

INVENTOR(S) : Pierre J. Leroy, Jean P. Bastien, Emile J. Sprunck

It is certified that error appears in the above-identified patent and that said Letters Patent are hereby corrected as shown below:

Col. 2, line 40, delete "expecially" and substitute therefor --especially--;

Col. 3, line 7, delete "FIg." and substitue therefor --FIG.--;

Col. 4, line 14, after "20" and before "30" insert --,--;

Col. 6, line 32, delete "n" and substitute therefor --n--;

Col. 6, line 33, delete "n" and substitute therefor --n--;

Col. 6, line 35, delete "n" and substitute therefor --n--;and

Col. 8, line 4, delete "neckeddown" and substitute therefor --necked-down--.

Signed and Sealed this

*Twenty-eighth* Day of *April 1981*

[SEAL]

*Attest:*

RENE D. TEGTMEYER

*Attesting Officer*

*Acting Commissioner of Patents and Trademarks*